US006000191A

United States Patent [19]

Kessler

[11] Patent Number: 6,000,191

[45] Date of Patent: Dec. 14, 1999

[54] STRUCTURE FOR RAISING A HINGED ROOF

[75] Inventor: Berthold M. Kessler, Plano, Tex.

[73] Assignee: Palm Harbor Homes, Inc., Dallas, Tex.

[21] Appl. No.: 08/920,754

[22] Filed: Aug. 29, 1997

[51] Int. Cl.[6] ..... E04B 1/349

[52] U.S. Cl. ..... 52/745.15; 52/71

[58] Field of Search ..... 52/64, 66, 71, 52/795.15, 795.16

[56] References Cited

U.S. PATENT DOCUMENTS

| | | | |
|---|---|---|---|
| 3,701,225 | 10/1972 | Perry | 52/71 |
| 3,727,354 | 4/1973 | Powell | 52/71 |
| 3,866,365 | 2/1975 | Honigman | 52/70 |
| 3,890,747 | 6/1975 | Van Der Lely | 52/64 |
| 3,971,185 | 7/1976 | Hendrich | 52/745 |
| 4,070,804 | 1/1978 | Van Der Lely | 52/64 |
| 4,545,171 | 10/1985 | Colvin | 52/79 |
| 5,209,030 | 5/1993 | Sloditskie et al. | 52/79.5 |

*Primary Examiner*—Beth Aubrey
*Attorney, Agent, or Firm*—Sidley & Austin

[57] ABSTRACT

A hinged support structure (30) is employed between a stationary beam of a building structure and a hinged roof portion. The hinged support structure (30) includes two support legs (34, 36) hinged together by a double hinge center bracket (38). The other end of the support legs (34, 36) are each coupled to a respective end bracket (40, 42) that allows pivotal motion of the support legs (34, 36) about two axes. A horizontal force is applied at the double hinged center bracket (38) by a cable to thereby move the support legs (34, 36) vertically apart, thus raising the hinged roof. Each of a plurality of hinged support structures (30) are fixed in the fully deployed position to thereby form a part of the permanent support structure between the hinged roof and the fixed beam.

27 Claims, 17 Drawing Sheets

STRUCTURE FOR RAISING A HINGED ROOF

TECHNICAL FIELD OF THE INVENTION

The present invention relates in general to methods and apparatus for raising hinged roofs, and more particularly to apparatus that allows different sections of a hinged roof to be raised simultaneously by a single worker, and where the apparatus forms a part of the roof support after being raised to its final position.

BACKGROUND OF THE INVENTION

Hinged roofs are commonly employed in the transportable sections of modular or manufactured (mobile) homes. Roof structures that are either partially or fully hinged are commonly utilized with mobile homes for allowing transportability thereof over public highways so as to easily pass under bridges, overpasses, power lines, and the like, but can be raised at the installation site to provide an aesthetically pleasing, peaked roof While there are many different types of hinged roof structures, they all share the common aspect that at the installation site, the hinged roof portions must be raised together to prevent undue bowing or distortion of the roof structure and corresponding damage thereto. It can be appreciated that the raising operation is no small task, in that many mobile homes, and thus the roof structures thereof, may be fifty-five feet or greater in length. A commonly used technique to raise a hinged roof structure is to employ a plurality of mechanical or hydraulic jacks, spaced about ten feet apart, and wedged between a lower stationary support beam and the hinged portion of the roof. The jacks can be operated simultaneously by plural workers to raise the roof sections in unison to the desired height. In the alternative, one person could raise each jack a small amount, thereby reducing the manpower but substantially increasing the amount of time required to complete the operation. In certain situations, the hinged portion of the roof must be raised somewhat higher than its final position to thereby allow vertical roof supports to be placed between the stationary ridgebeam and the raised roof Then, the roof is lowered onto the vertical supports and fastened thereto. As can be appreciated, this technique necessitates the separate shipping and handling of the jacks, as well as the vertical supports. It is not uncommon that these separate pieces, even if shipped with the mobile home itself, become lost, damaged or mislaid, thereby delaying the installation operation.

According to other installation techniques, the vertical roof support members, which may be two-by-fours, or the like, are fastened in a hinged manner to the rafters of the hinged roof structure. Thus, when the roof is raised upwardly, the vertical roof support members are hinged downwardly and then fastened to the stationary ridge support beam. While this technique facilitates the installation, many of the same disadvantages noted above are still present.

From the forgoing, it can be seen that a new technique is needed for easily raising all sections of a hinged roof simultaneously, with only one worker required. Another need exists for roof raising apparatus employed with a hinged roof so that it cannot be over-raised, thereby reducing the potential harm to the roof structure. Another need exists for a structure and apparatus utilized for raising a hinged roof, where the raising apparatus remains as the principal support of the roof after raising thereof. Yet another need exists for a structure and apparatus for raising a hinged roof, where all the parts can be fastened to the roof structure at the manufacturing facility, and no further assembly is required at the installation site.

SUMMARY OF THE INVENTION

Disclosed are methods and apparatus for eliminating or substantially reducing the problems and shortcomings attendant with the prior art roof raising structures. In accordance with the principles and concepts of the invention, a support structure comprising two legs is hinged at its midsection. The support legs are thus able to be folded together in a compact position, and also allowed to be unfolded to an expanded position. The top and bottom ends of the hinged support structure are fastened by respective end brackets between a stationary beam of the building structure that extends horizontally, and a hinged roof section. The end brackets allow each leg to pivot about a hinged connection to the respective end bracket.

In accordance with a preferred embodiment of the invention, a cable passes through the hinged joint of plural support structures. A cable clamp is fastened to the cable and engages with each such hinged center joint. When the hinged roof is at its lowered position, the hinged support structures are folded and collapsed to a compact condition. When the cable is pulled in a horizontal direction the hinged center joint of each support structure is caused to move horizontally together, thereby unfolding and vertically separating the support legs and causing the hinged roof to be raised. When the two support legs of the hinged support structure are aligned and coaxial with each other, the hinged center joint is nailed or otherwise fastened to prevent further pivotal action. The two legs of each hinged support structure thus form a permanent part of the roof structure and maintain the hinged roof in the raised position.

If desired, the nails at the hinged center joint can be removed, and the operation reversed to thereby lower the roof for transportability of the mobile home.

In the preferred embodiment, the hinged support structure includes two support legs joined at the center ends thereof by a double hinge center bracket. Each support leg, preferably constructed as a wooden strut, is fastened to the center bracket by way of a door-type hinge and screws. Formed centrally within the double hinge center bracket is a hole through which a cable is passed until engaged with the cable clamp for forcing the center bracket horizontally, to thereby unfold and force the support legs apart.

In the preferred form of invention, the end bracket provides a hinged or pivotal movement of the support leg about two axes. A door-type hinge is welded or otherwise formed integral with the end bracket to allow the support leg to hingeably move and allow the support leg to move from a compact, folded position, to a fully deployed position where the two support legs become a single straight support structure. The end of each support leg is also fastened to the end bracket by way of a respective bolt for allowing the support leg to pivot with respect to the hinged connection about a second axis. In this manner, as the hinged roof moves from its collapsed position to the fully deployed position, the slight pivotal movement of each support leg is allowed about the second axis. Once the support legs are forced into a straight or linear support structure, they are fixed by driving nails through the double hinge center bracket into the wooden support legs.

In accordance with the preferred embodiment of the invention, the double hinge center bracket of each hinged support structure engages with a respective cable clamp. In one embodiment, the cable is extended horizontally and around a cable support bracket fastened to the end of the ridgebeam, and then routed to a ratchet-type winch that is fastened to the ridgebeam. The cable guide bracket prevents the cable from wearing into the end of the ridgebeam, and provides alignment of the cable with respect to the winch. In accordance with an important feature of the invention, the force imparted by the cable to each of the hinged support structures fastened on one side of the ridgebeam, is offset by the opposite pulling force of the winch which is fastened on the other side of the ridgebeam. With this arrangement, no net horizontal force is exerted on the roof structure, thereby preventing any distortion or undue stress on the roof structure.

In the preferred embodiment, half of the hinged support structures are mounted so as to unfold in one direction, and the other half are mounted so as to unfold when pulled in an opposite direction. A worm gear mechanism is mounted in the center and has the cable wound thereon so as to pull each end of the cable in opposite directions. When each cable is threaded through its associated double hinged center brackets of the hinged support structures, and engaged therewith with cable clamps, the roof can be easily raised when the worm gear mechanism is activated.

In accordance with other embodiments, pairs of support structures can be utilized where separate cables are pulled in opposite directions to unfold the respective hinged support structures to extended positions to thereby raise the hinged roof and provide a sturdy permanent roof support. In another embodiment, an elongated threaded rod can replace the cable, so as to threadably engage with a threaded collar in the double hinge center bracket. In this manner, the threaded rod need only be rotated to cause unfolding and extension of the pairs of support structures.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, elements or functions throughout the views, and in which.

DETAILED DESCRIPTION OF THE INVENTION

Figure 1A:
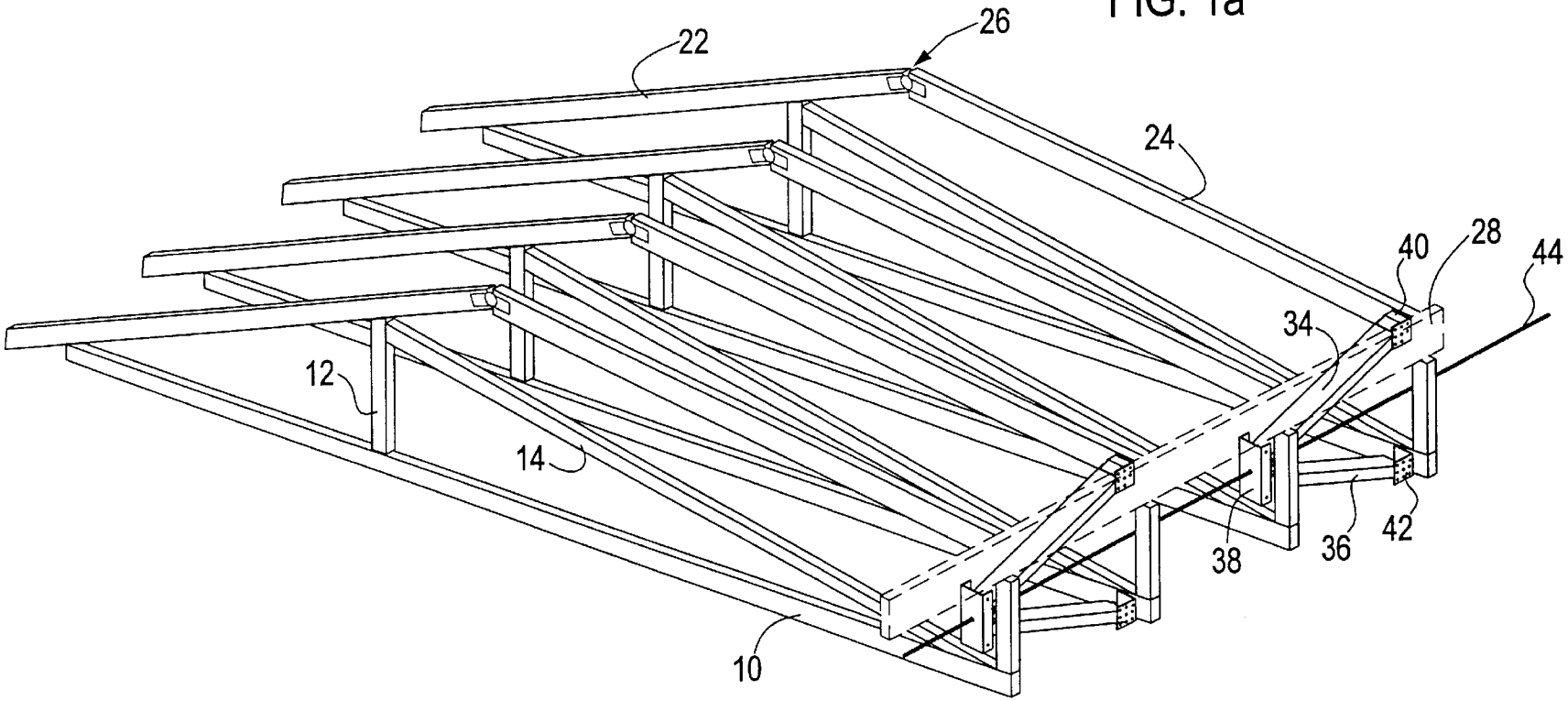
FIG. 1*a* and FIG. 1*b* illustrate respective isometric views of a hinged roof structure in a lowered position, and then in a raised position by the apparatus according to the invention.

FIG. 1*a* depicts a conventional hinged roof structure equipped with the raising apparatus constructed according to one embodiment of the invention. It is to be noted that the roof structure is shown without a ridgebeam for purposes of clarity. Also, while the invention is described in conjunction with wood members, it is well adapted for use with metal members. In the building structure shown, the stationary parts include the ceiling joists 10, the ceiling strut and truss members 12 and 14, the ridgebeam 16 (not shown). While the invention is shown installed in connection with a roof of the type in which a portion is stationary and another portion is hinged and can be raised, the invention is equally applicable to the types of roofs in which the entire roof portion is hinged.

Figure 1B:
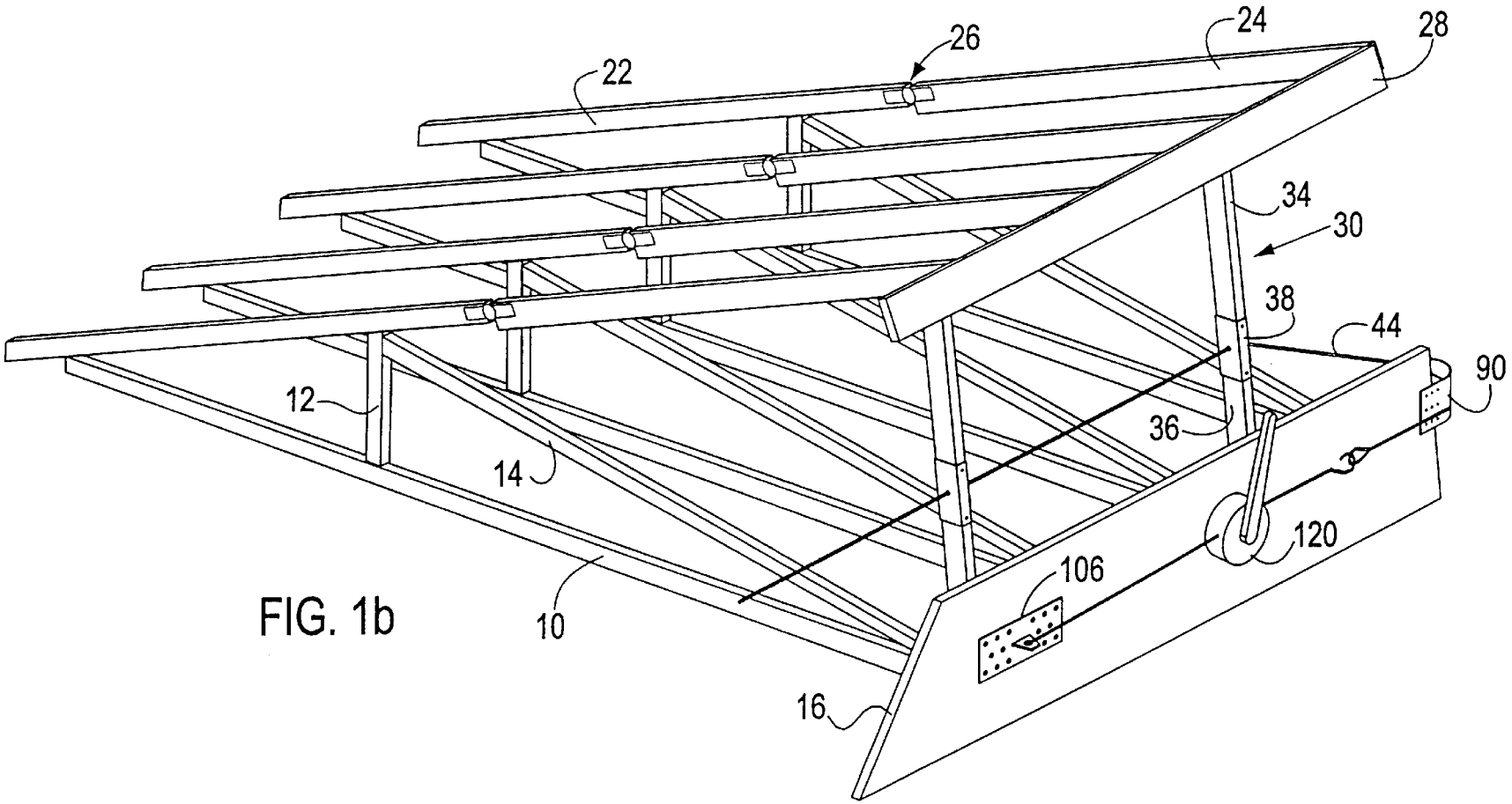

The movable portion of the roof, more clearly shown in FIG. 1*b*, includes rafters 24 that are hinged at respective joints 26 to the stationary rafters 22. A hinge suitable for use at the joint 26 can be a standard door-type hinge nailed or screwed to the respective stationary and movable rafters 22 and 24. The end of each movable rafter 24 at the peak of the roof is laterally supported by an edgerail 28 butted and nailed thereto. The structural components of the roof, both as to the stationary and movable sections, are constructed in a conventional manner using wood of suitable widths to provide the degree of support and structural integrity needed.

As noted above, hinged roofs of the type shown have been conventionally raised by the use of numerous jacks, or by the use of a crane and cable structure for elevating the movable portion of the roof to the position shown in FIG. 1*b*. After raising the roof in the conventional manner, wood supports had to be installed between the peak of the roof and the stationary portion of the building structure. Then, the jacks or crane equipment was removed. While not shown, another half of the mobile home is constructed in a similar manner, and the roof raised as noted above. Then, halves of the mobile home are placed together and fastened so that a highly peaked roof is obtained. The peaked roof of a mobile home more accurately portrays a conventional house, and thus is desirable.

In accordance with an important feature of the invention, neither jacks nor cranes are necessary in raising the roof of a hinged roof structure. Rather, the roof raising equipment of the invention is installed at the factory so as to be an integral part of the roof structure, and no additional equipment is required at the installation site. Hence, time delays are not involved in replacing lost, broken or stolen pieces that are required in raising a hinged roof structure.

Figure 2:
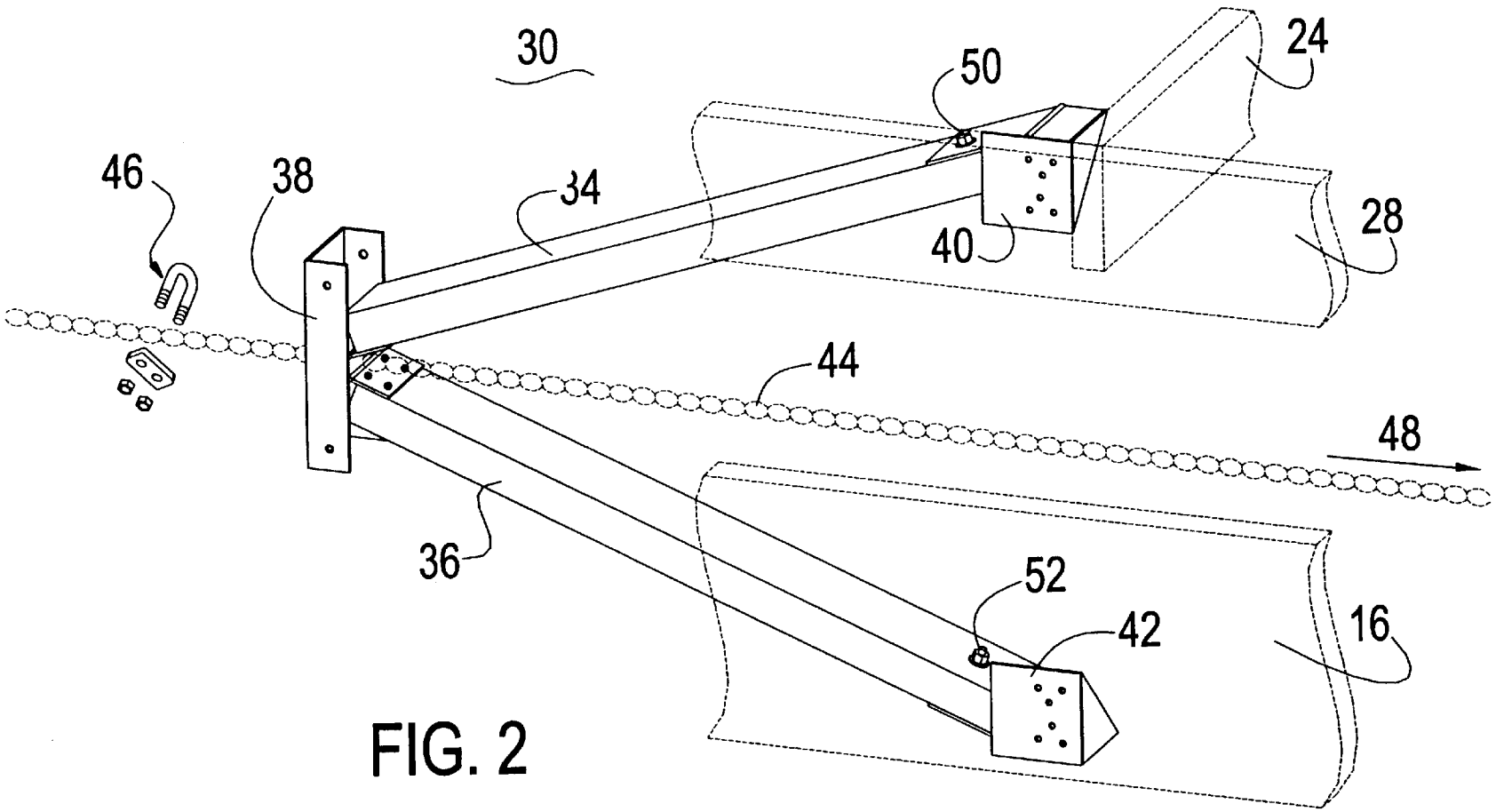
FIG. 2 illustrates one of a plurality of hinged support structures utilized in raising the hinged roof.

The roof raising equipment of the invention includes a hinged support structure 30, shown in more detail in FIG. 2.

Each hinged support structure is preferably joined between a stationary portion of the building structure and the movable roof portion, at 32–48 inch intervals. Each hinged support structure 30 is preferably fastened between the ridgebeam 16 and the edgerail 28 as shown in FIG. 2. The hinged support structure 30 includes a first support leg 34 constructed of wood, or the like, and a second support leg 36, each fixed for hinged movement to a double hinge center bracket 38. In this manner, the support legs 34 and 36 can be compactly folded, or expanded outwardly to effectively increase in length. Each support leg 34 and 36 is preferably of the same length, although they need not be. The length of each support leg is dependent on the pitch of the roof and the pitch of the interior cathedral. Movably fixed at the other end of each support leg is a respective end bracket 40 and 42. Each end bracket 40 and 42 is identically constructed of steel with suitable thickness to provide the structural integrity required in the raising and supporting of the hinged roof Each end bracket 40 and 42 is nailed, screwed or otherwise fastened to the respective ridgebeam 16 and/or spacer blocks and edgerail 28.

A wire rope or cable 44 is passed through a hole (not shown) in the double hinge center bracket 38. The cable 44 is coupled to each of the hinged support structures 30 in a similar manner. Importantly, a respective cable clamp 46 is fastened to the cable and becomes abutted against each double hinge center bracket 38 when the cable 44 is pulled in the direction shown by arrow 48. When the cable 44 is pulled in such direction, a horizontal force is exerted on the double hinge center bracket 38, whereupon the upper and lower end brackets 40 and 42 are caused to move apart vertically. This effectively unfolds the hinged support structures and raises the hinged portion of the roof upwardly with respect to the stationary ridgebeam 16. The support legs 34 and 36 are pivotally coupled to the end brackets 40 and 42 by respective bolts 50 and 52. As will be described in more detail below, because the hinged portion of the roof moves vertically in an arcuate manner about a horizontal axis, a small degree of pivotal movement of each support leg 34 and 36 is required with respect to the end brackets 40 and 42.

Figure 3B:
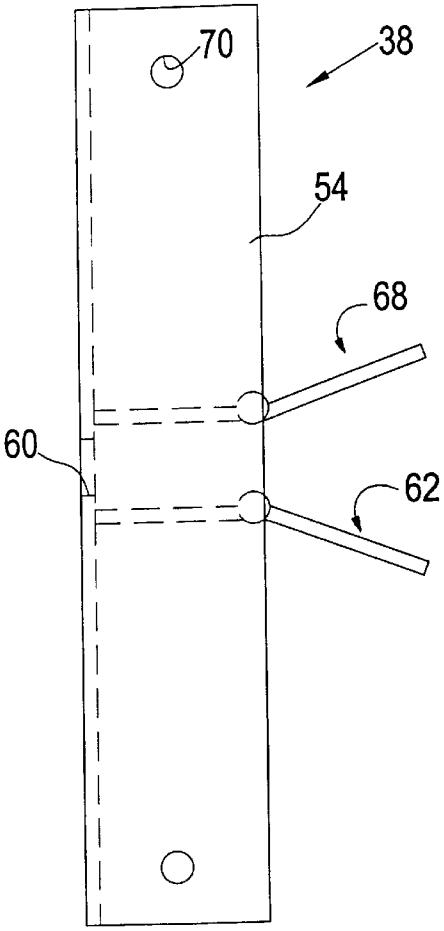
FIGS. 3*a* and 3*b* illustrate respective isometric and side views of a double hinged center bracket for coupling together the ends of two support legs.
Figure 3A:
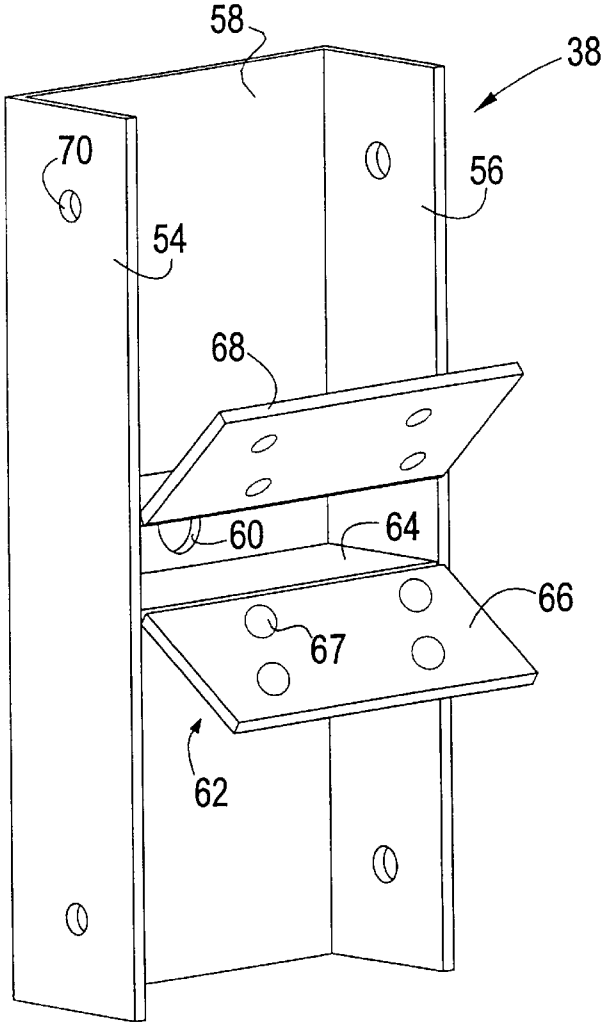

The double hinge center bracket 38 is shown in more detail in FIGS. 3*a* and 3*b*. The center bracket 38 is preferably constructed of a steel material in the shape of a channel. The channel comprises spaced apart side plates 54 and 56 connected by a spanning web 58. The side plates 54 and 56 are spaced apart so as to fit around a standard two-by three, a two-by-four, or equivalent support structure. The hole 60 is formed in the web 58 of the center bracket for allowing the cable 44 to freely pass therethrough. As noted above, the cable clamp 46 will not pass through the hole 60, and thus when the cable 44 is pulled the clamp 46 engages with the side surface of the web 58 adjacent to the hole 60. It is contemplated that the cable clamp, or at least a portion thereof, will be welded or otherwise fixed to the spanning web 58.

A standard door-type hinge 62 is fixed to the center bracket 38 by welding one flap 64 of the hinge 62 to the side plates 54 and 54, as well as the web 58. The other flap 66 of the hinge 62 includes screw or nail holes 67 for fastening to the wooden support legs 34 or 36. A second hinge 68 is fastened on the opposite side of the hole 60 in a manner similar to the first hinge 62. With this arrangement, the wooden support legs 34 and 36 shown in FIG. 2 can be hingeably moved with respect to the center bracket 38. The hinges 62 and 68 allow the wooden support legs to be hinged and unfold to an extent so as to be aligned with each other and provide a straight unitary support member. The web 58 of the center bracket functions as a stop and prevents over rotation of the support legs 34 and 36 once they are aligned in a straight line. When the leg supports 34 and 36 are hingeably moved and completely unfolded so as to be straight and aligned with each other, they are fixed in such a position by driving nails (not shown) through the nail holes 70 in the center bracket 38 into the wood support legs.

Figure 3D:
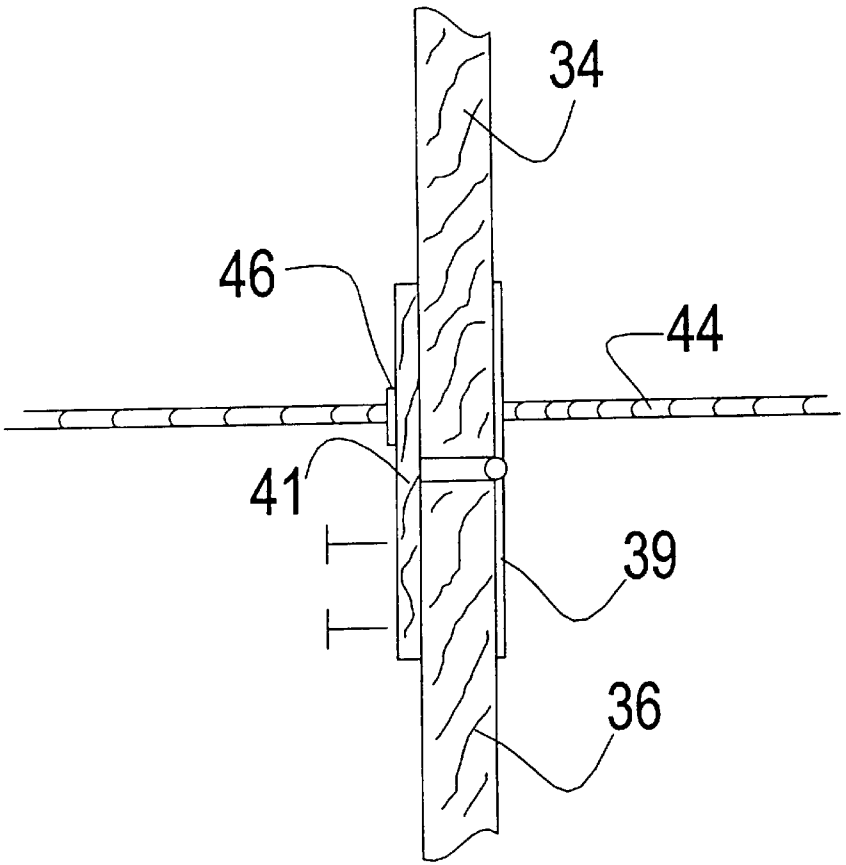
FIGS. 3*c* and 3*d* are side views, illustrating another arrangement for hinging two support legs together and preventing over rotation thereof.
Figure 3C:
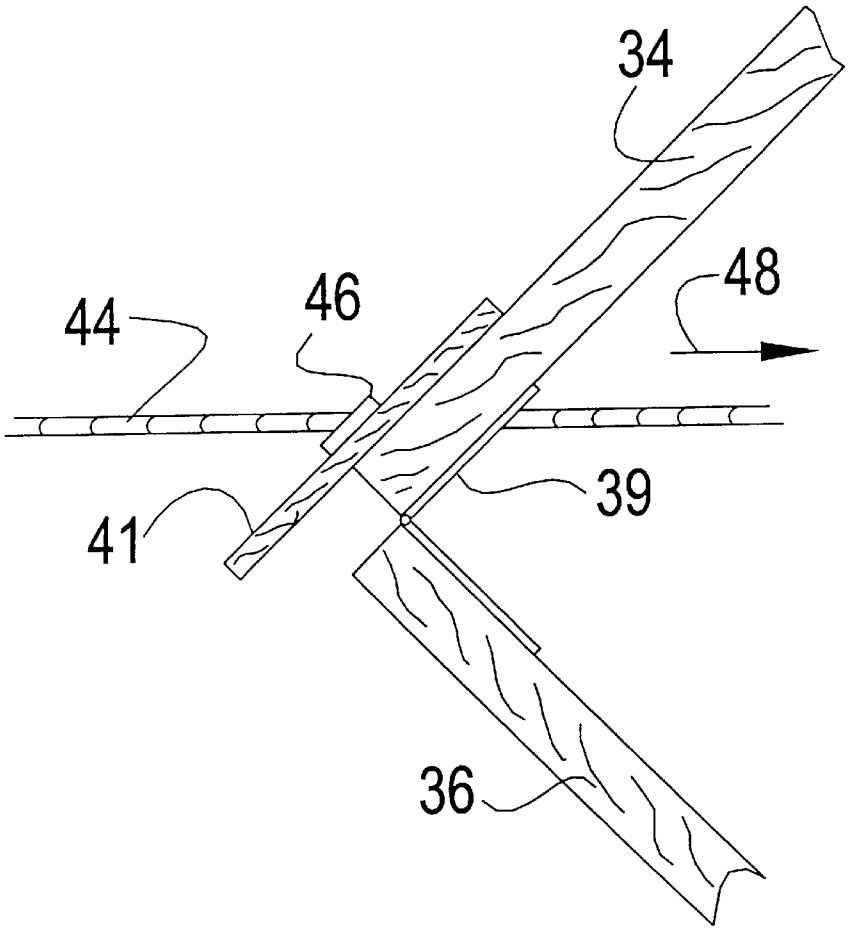

While the double hinge center bracket 38 is sturdy and adapted to prevent over rotation of the support legs 34 and 36, those skilled in the art may prefer to employ a single strap-type hinge 39 for hinging the support legs 34 and 36 together. This is shown in FIGS. 3*c* and 3*d*. Either one of the support legs 34 or 36, or the hinge 39 would need some type of capturing hole or elongated slot to support the cable and allow engagement with the cable clamp 46. As yet another alternative, a single long cable is not an absolute necessity. Rather, each hinged support structure can be fastened to a neighboring hinged support structure by a short section of cable. With this arrangement, when the end support structure is pulled by a cable connected to a winch, all other support structures will correspondingly move, much like a train. Other stop-type structures can be employed, such as a piece of wood 41 nailed to one support leg 34 and which extends beyond the hinged end thereof Again, when both support legs 34 and 36 are moved so as to be aligned in a straight line, the piece of wood 41 prevents over rotation. Once aligned, the piece of wood 41 can be nailed to the other support member.

Figure 4:
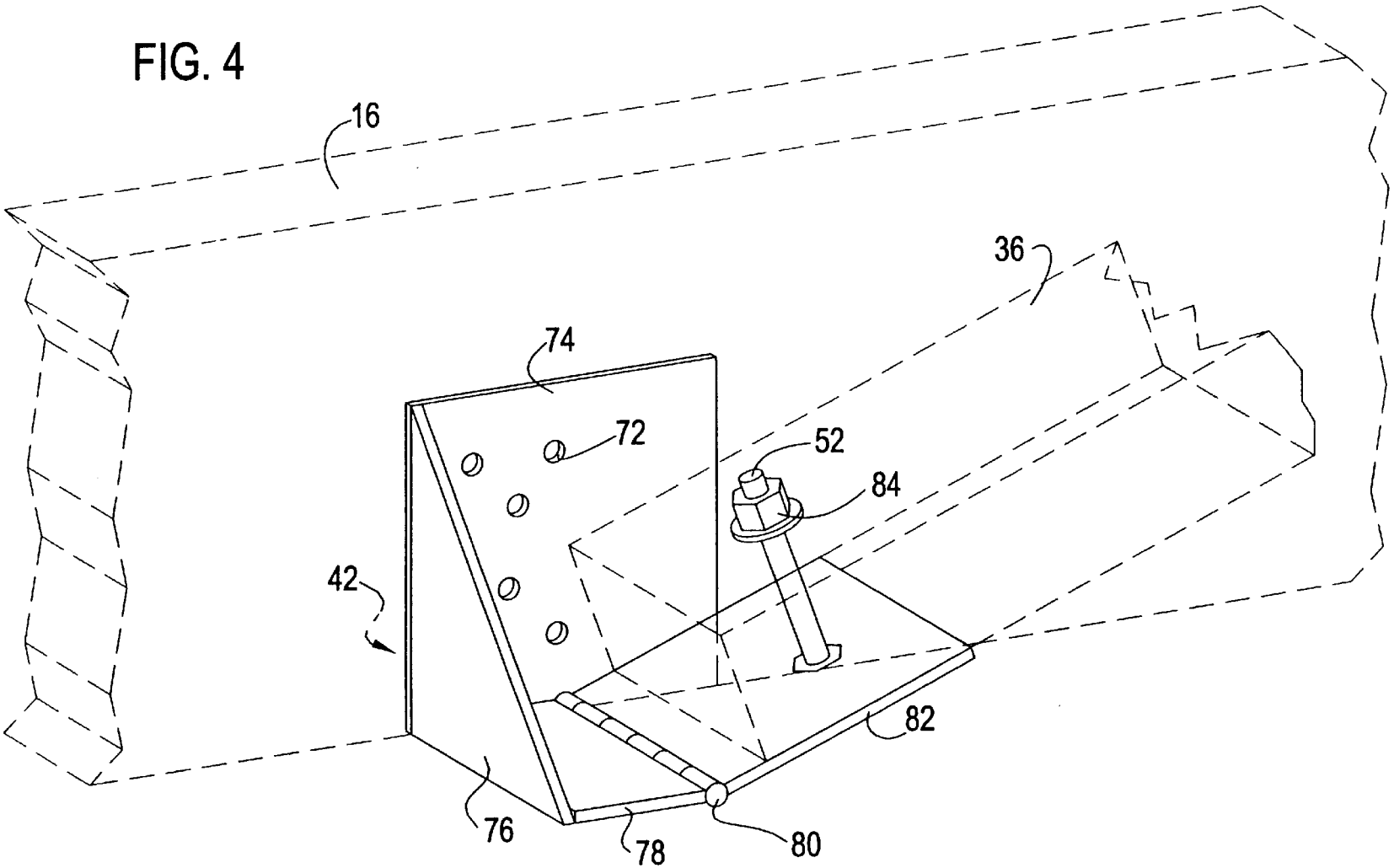
FIG. 4 illustrates an angle bracket connected to an end of each support leg to provide two axes of pivotal movement thereto.

With reference now to FIG. 4, there is shown the lower end bracket 42 of a pair of such brackets adapted for fixing the ends of the support legs 34 and 36 between the hinged roof and a stationary beam of the building structure. The end bracket 42 is fastened by nails (not shown) driven through holes 72 into the ridgebeam 16 and/or spacer block. The end bracket 42 is constructed using an angle member 74 and a triangular-shaped gusset 76 welded thereto for purposes of support. One flap 78 of a hinge 80 is welded to the gusset 76. It is noted that the length of the hinge flap 78 should be at least as thick as the support leg 36 so that the support leg can be situated between the rotational axis of the hinge 80 and the gusset 76 when the support leg 36 is hinged to a vertical orientation. Importantly, when the support leg 36 is moved about the axis of the hinge 80 to a vertical position, it abuts against the inside surface of the gusset 76. The gusset 76 thus functions as a stop to prevent over rotation of the support leg 36.

The other flap 82 of the hinge 80 has welded thereto a threaded stud or bolt 52. In the alternative, a simple bolt can be passed through a hole in the hinge flap 82. The bolt 52 is of sufficient length as to pass through a hole in the wood support leg 36. A nut 84 and a washer (not shown) can be utilized to clamp the wood support leg 36 to the flap 82 of the hinge 80. However, it is important that the support leg 36 be able to pivotally move about the bolt 52 during raising of the hinged roof. The angular degree by which the wood support leg 36 pivots about the bolt 52 is small, but nevertheless such pivotal action is required when raising a hinged roof a significant amount. This will be described below in connection with FIGS. 8*a* and 8*b*. It is noted that the upper end angle bracket 40 is similarly, although not identically constructed, and fastened to the edgerail 28 of the hinged roof.

Figure 5A:
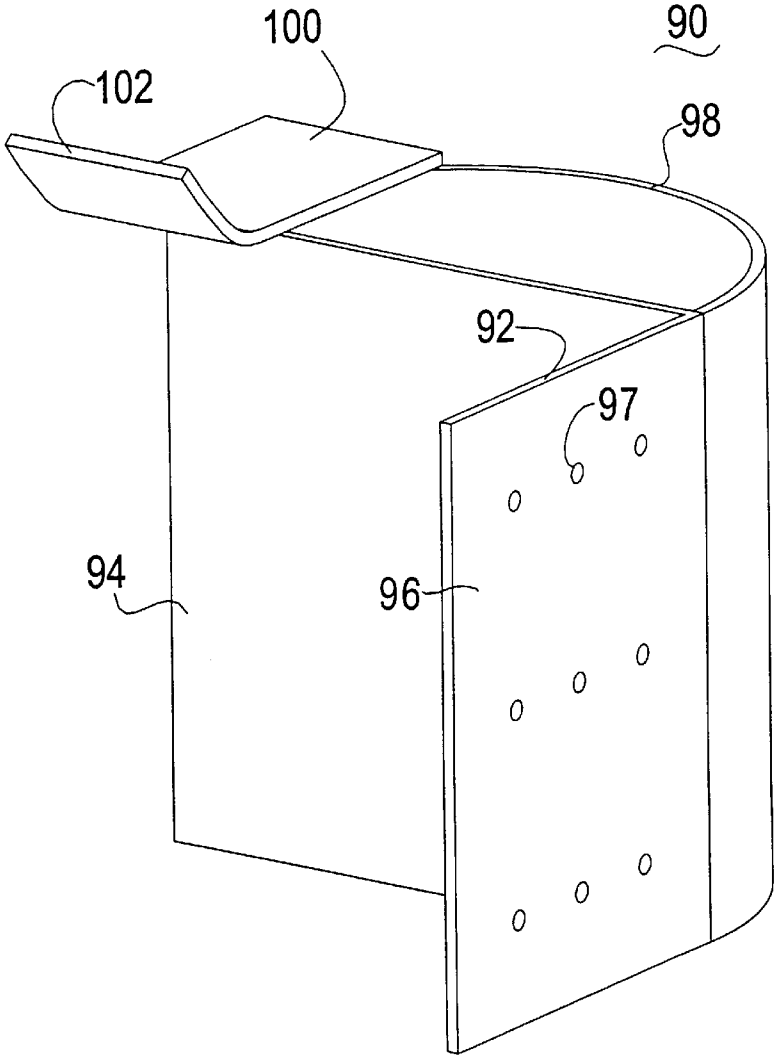
FIGS. 5*a* and 5*b* illustrate respective isometric and partial rear views of the cable support bracket constructed according to the invention.
Figure 5B:
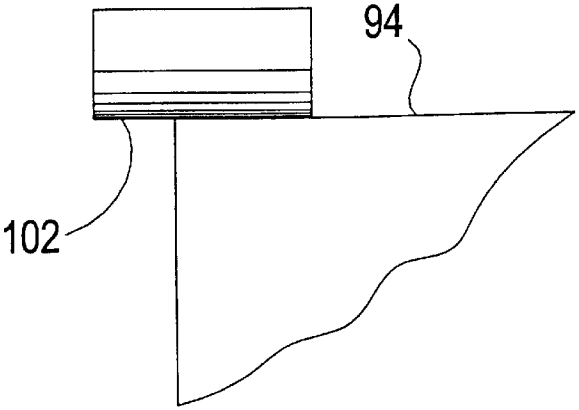

Referring now to FIGS. 5*a* and 5*b*, there is shown the cable guide bracket 90. The cable guide bracket 90 is fabricated using an angled steel plate 92. A first part 94 of the plate 92 is constructed with a width substantially the same as the width of the ridgebeam 16. The other part 96 has a number of holes 97 for nailing or otherwise fastening the cable guide plate bracket 90 to the side of the ridgebeam 16. Welded to the outside surface of the part 94 is a semi-circular or rounded portion 98. The rounded portion 98 can be formed by cutting in half a pipe or similar tubular material. Sheet metal stock can also be formed with a curved part and welded to the plate members. The circular part 98 functions to provide a contoured surface around which the tensioned cable is pulled to thereby prevent cutting into the end of the ridgebeam 16. In order to prevent the cable from slipping off the top of the rounded part 98 during raising of the hinged roof, a cable retainer 100 is welded to both the end plate 94 and the rounded part 98. The cable retainer 100 has an upturned end 102 to prevent nicking or gouging of the wire strands of the cable 44 when pulled in tension around the rounded part 98.

Figure 6:
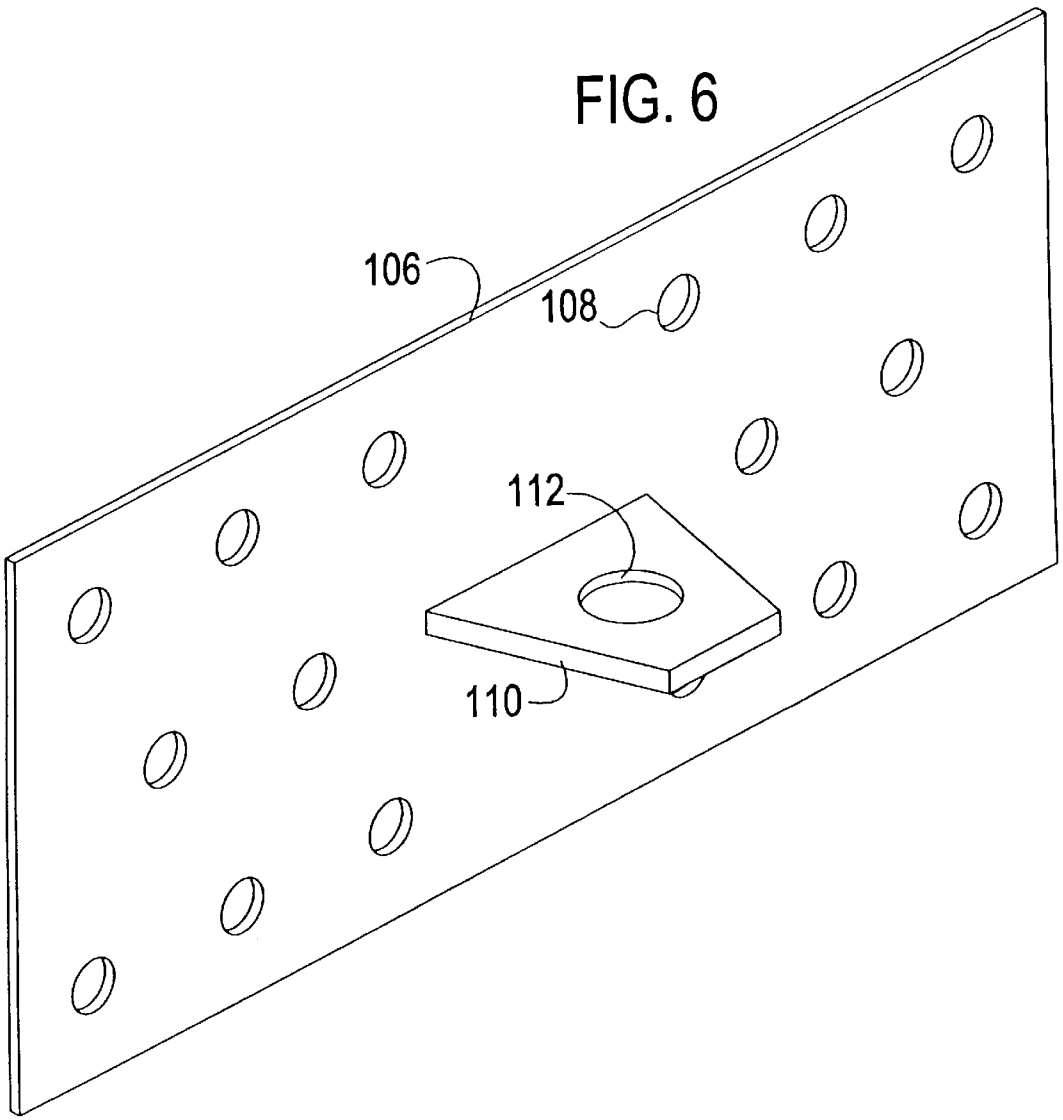
FIG. 6 illustrates an isometric view of a cable anchor plate constructed according to the invention.

With reference to FIGS. 1*b* and 6, there is illustrated a cable anchor plate 106. The cable anchor plate 106 has a number of holes 108 for nailing to the outside surface of the stationary ridgebeam 16. An apertured tab 110 is welded to the anchor plate 106. A hole 112 is formed in the tab 110 for looping an end of the cable 44 therethrough and anchoring the same to the ridgebeam 16. The winch 120 shown in FIG. 1B is hand operated so that when turned, the overall length of the cable 44 is shortened, thereby pulling on each of the support structures 30 via the cable clamps 46, thereby causing the support legs of each support structure to be unfolded and straightened and lift the hinged roof upwardly. The winch 120 is of the ratchet type that is conventionally available and that can be temporarily attached to the ridgebeam 16 if necessary. Of course, those skilled in the art may prefer to use other winch-type mechanisms such as standard come-alongs or other similar devices for shortening the effective length of the cable 44.

Figure 7A:
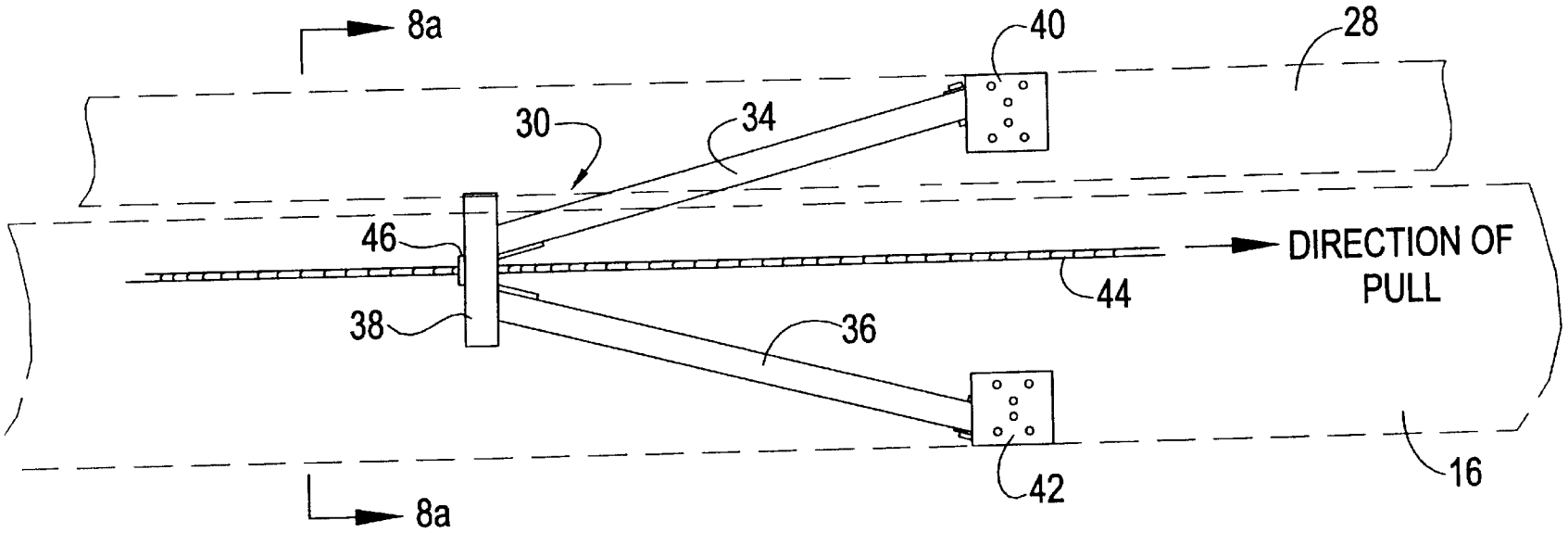
FIGS. 7*a*–7*c* illustrate the various stages in raising a hinged roof according to the method of the invention.
Figure 7B:
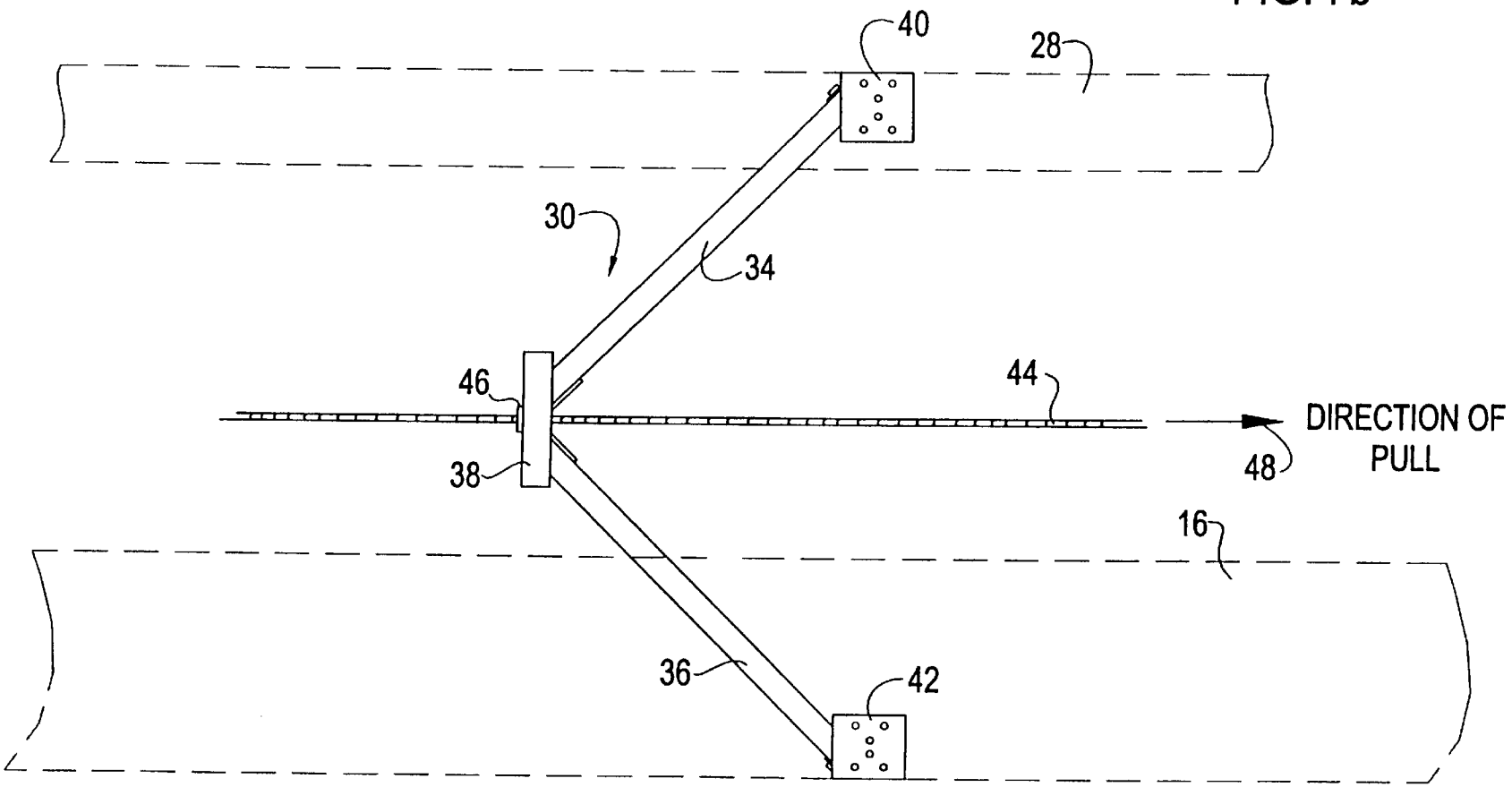
Figure 7C:
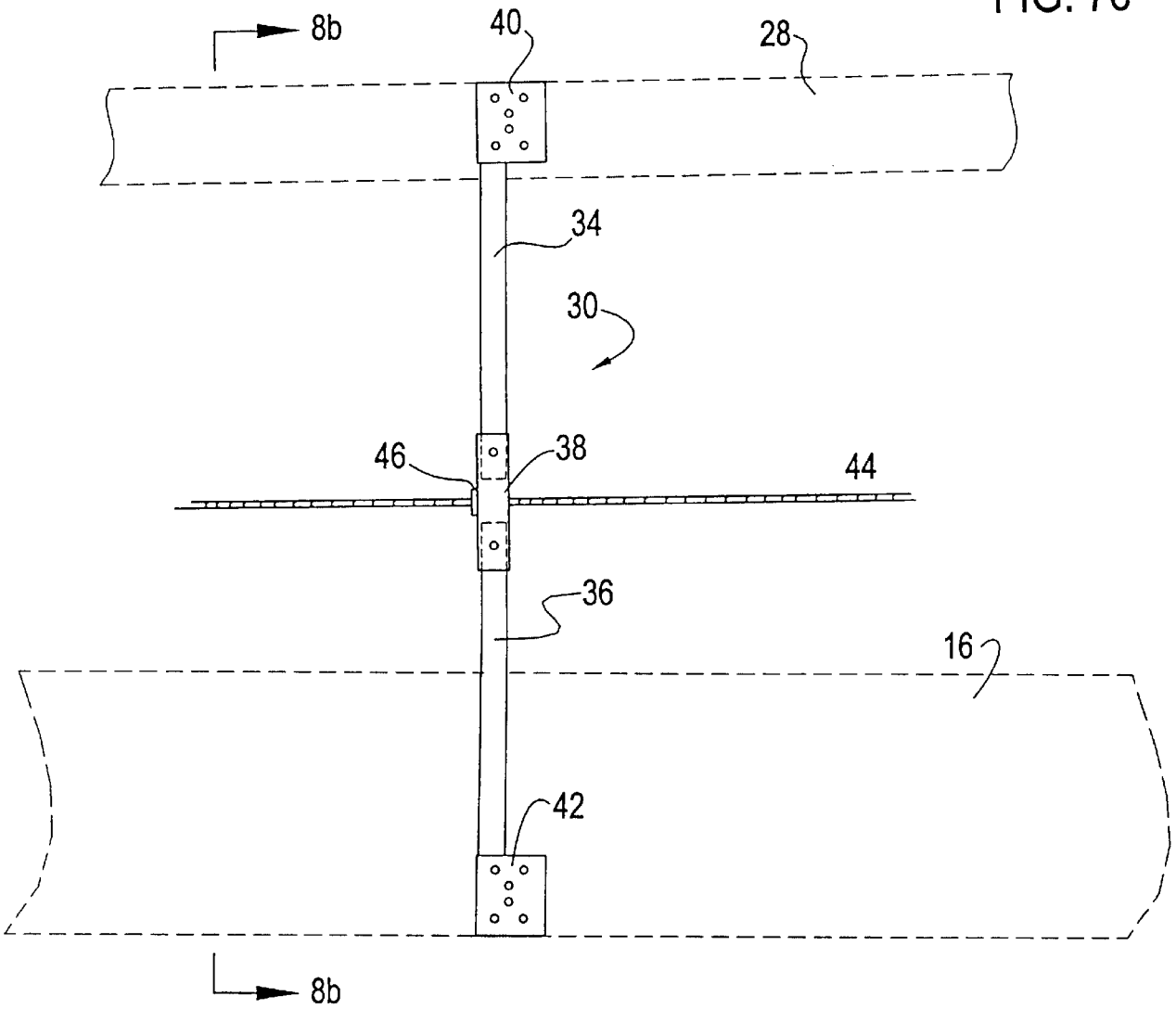

FIGS. 7*a*–7*c* illustrate the various stages in raising the hinged roof from a lowered position to a fully deployed position. These figures are frontal views, with the ridgebeam 16 and the edgerail 28 shown in phantom to clearly illustrate the orientation of the hinged support structure 30 during raising of the hinged roof It should be noted that each of the plural hinged support structures 30 function in the same manner depicted in FIGS. 7*a*–7*c*. With a roof length of 55–70 feet, twenty-five or more hinged support structures 30 may be required to simultaneously raise and support the entire hinged portion of the roof.

With specific reference to FIG. 7*a*, there is shown the hinged roof in a lowered position, with the edgerail 28 resting on the stationary ridgebeam 16, each such beam shown in phantom. Fastened on the backside of the ridgebeam 16 is the lower end bracket 42, which is also coupled to the lower support leg 36 by way of the hinge 80 and bolt 52 shown in FIG. 4. As noted above, such a structure provides the support leg 36 with two pivotal axes of movement. The top end bracket 40 is fastened to the edgerail 28, as shown, and also provides the top support leg 34 with two axes of pivotal movement. As fully described above, each support leg 34 and 36 is hingeably connected at one end thereof to the double hinge center bracket 38, shown in more detail in FIGS. 3*a* and 3*b*.

The lefthand end of the cable 44, not shown, terminates at the cable clamp of the last hinged support structure. The cable 44 passes through the double hinge center bracket 38 and is engaged therewith by the cable clamp 46. It is important to note that when the hinged roof is in a fully lowered position, the top end bracket 40 and the bottom end bracket 42 are spaced apart vertically a distance depending on the pitch of the roof. This reduces the initial pulling force on the cable 44 that is necessary to commence movement of the double hinge center pivot bracket 38 laterally to the right, thereby vertically separating the edgerail 28 upwardly from the stationary ridgebeam 16. The end brackets 40 and 42 may be constructed to provide a further vertical offset separation to facilitate the initial raising of the hinged roof.

FIG. 7*b* illustrates the partial separation of the edgerail 28 upwardly from the stationary ridgebeam 16, due to the movement of the cable 44 to the right, as shown by arrow 48. With each of the plural hinged support structures 30 functioning in substantially an identical manner, the entire hinged roof is uniformly raised to thereby reduce or eliminate any distortion or stresses in the roof structure. In addition, all that is required is a single pulling force on the cable 44 to cause each hinged support structure 30 to operate in unison.

FIG. 7c illustrates the edgerail 28, and thus the hinged roof, in a fully raised position, with the top support leg 34 being vertically aligned with the bottom support leg 36. When the hinged roof has been deployed to the fully raised position, the hinged support structures 30 remain as an integral part of the vertical structural support for the roof. Nails or other fasteners can be driven through the holes 70 (FIG. 3*a*) of the double hinge center bracket 38 and into both wood support legs 34 and 36. This fixes the support legs 34 and 36 in a vertically aligned position, such as shown in FIG. 7*c*. When the hinged roof is fully raised and the hinged support structures 30 are secured, the tension on the cable 44 can be relaxed by the winch 120. The winch 120 and the cable guide end bracket 90 can then be removed, as well as the cable 44 itself. In the alternative, the end of the cable that is otherwise coupled to the winch 120 can be securely anchored to the ridgebeam 16 to add additional lateral stability to the center portions of the hinged support structures 30. Those skilled in the art may even prefer to add an additional cable clamp on the right-hand side of each double hinge center bracket 38 to provide bidirectional lateral support on both sides of each hinged support structure 30. With such a construction, any bowing of the individual hinged support structures 30 due to heavy loads, such as a wet snow, is reduced, thereby allowing increased loads on the hinged roof structure. In order to provide yet additional roof support, those skilled in the art may prefer to add yet other wood cross supports between the ridgebeam 16 and the lower support leg 36, as well as the upper edgerail 28 and the support leg 34.

Figure 8B:
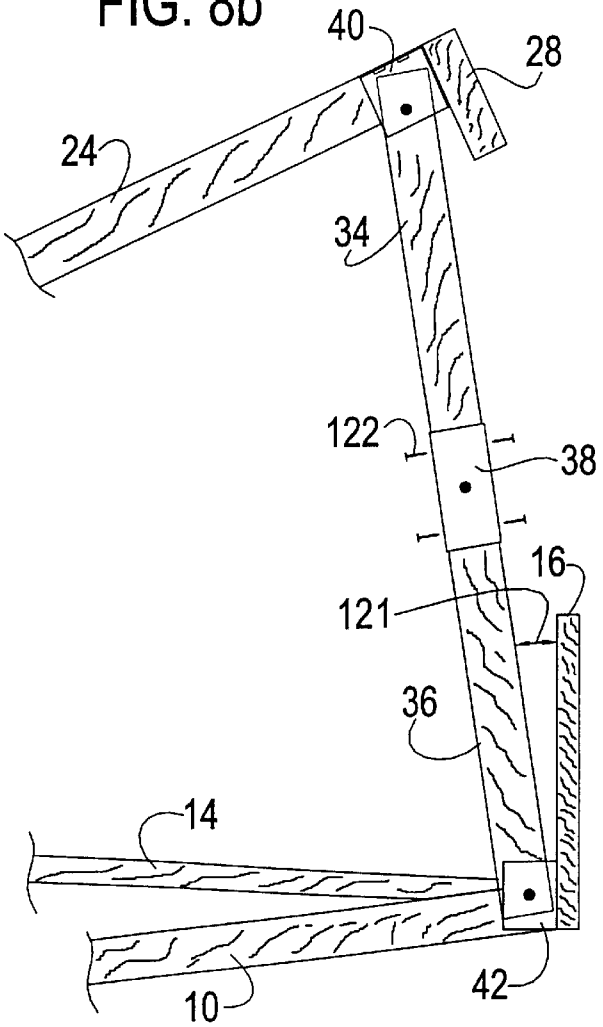
FIGS. 8*a* and 8*b* illustrate side views of a hinged roof in a respective lowered position and in a raised position.
Figure 8A:
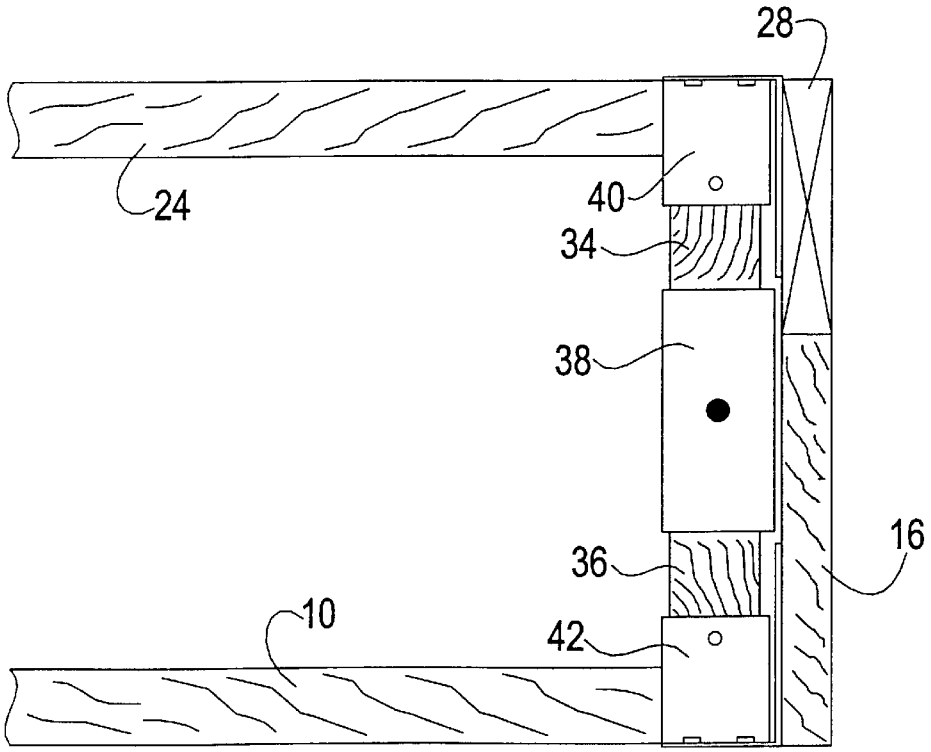

With reference to FIGS. 8*a* and 8*b*, there is shown the extent of the pivotal movement of the support legs 34 and 36 about the respective bolts 50 and 52. As can be seen in FIG. 8*a*, the lower support leg 36 has left and right edges that are essentially parallel with the side surfaces of the vertically fixed edgebeam 16. However, when the hinged roof is fully raised, as shown in FIG. 8*b*, the lower support leg 36 is no longer parallel to the ridgebeam 16, but rather is disposed at an acute angle shown by reference numeral 121. The pivotal movement of the support leg 36 about the bolt 32 is due to the pivotal movement of the hinged roof rafter 24 about an axis at the far left of the drawing (not shown). The top support leg 34 pivots about the bolt 50 of the top end bracket 40 in a similar manner. As can be seen in FIG. 8*b*, when the hinged roof is fully raised, and the top support leg 34 is vertically aligned with the bottom support leg 36, nails 122 are driven through the holes in the double hinge center bracket 38 into the wooden legs. When the hinged roof is fully raised and secured as noted in FIG. 8*b*, one mobile home half can be mated with another mobile home half, and the respective ridgebeams 16 securely fastened together. As can be appreciated, there may exist a gap at the peak of the two raised roof structures, which can be covered with a roof extension in a conventional manner.

Figure 9:
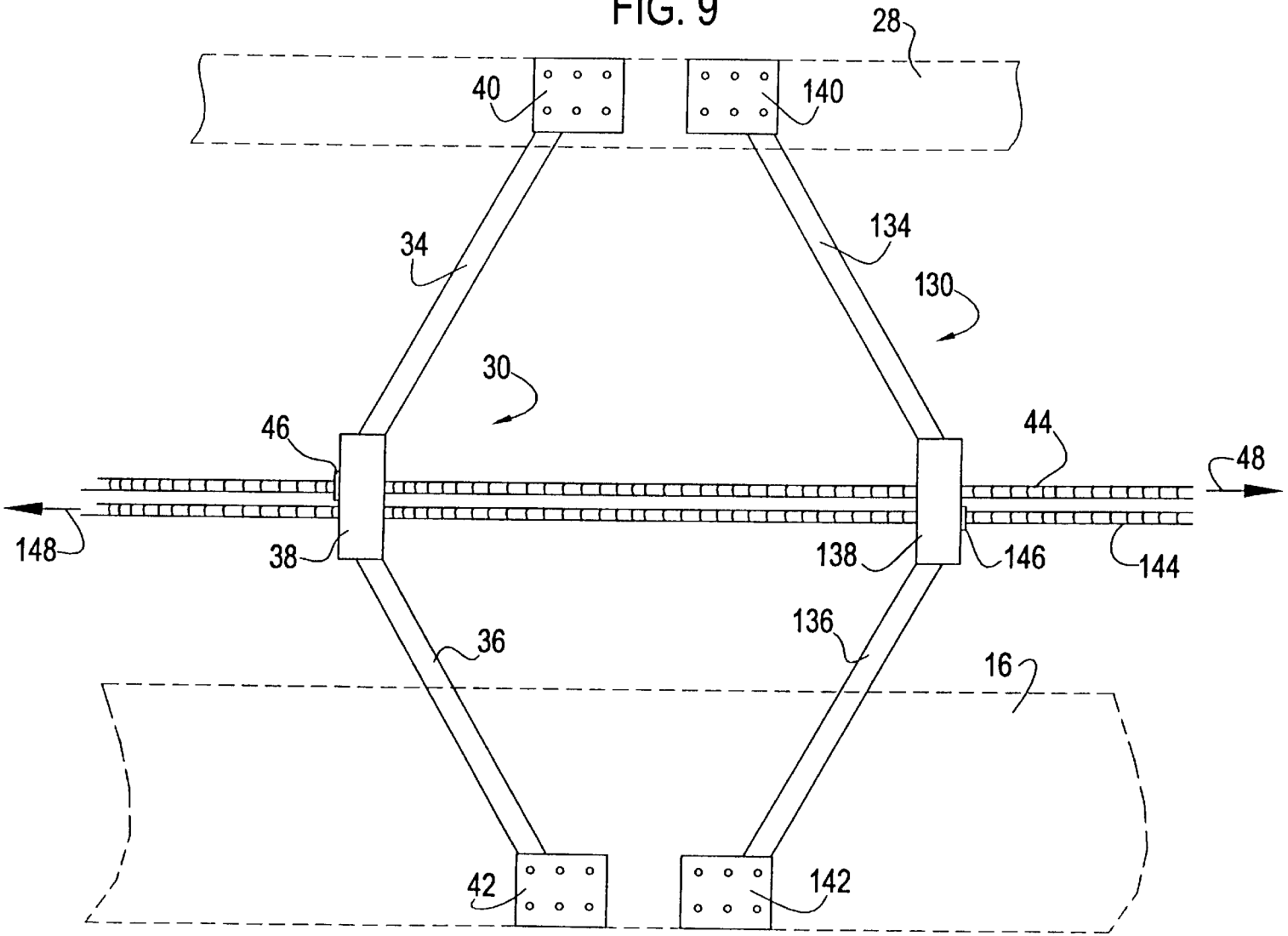
FIG. 9 is a side view of a pair of hinged support structures operated by respective cables pulled in opposite directions to raise a hinged roof.

FIG. 9 illustrates another embodiment of the invention that can be advantageously utilized when additional vertical support is required between the stationary ridgebeam 16 and the movable edgerail 28. Here, a pair of vertical support structures are utilized, one identified by reference numeral 30 and the other by reference numeral 130. The hinged support structure 30 is substantially identical as described above in connection with FIG. 2. The corresponding hinged support structure 130 is similar, except constructed in a reverse manner. The double hinge center bracket 138 can be constructed identical to that employed in the hinged support structure 30, but rotated 180° about a vertical axis. The double hinge center brackets 38 and 138 would require an additional cable hole there second cable 144. A topa first cable 44 and a second cable 144. A top end bracket 140 and a bottom end bracket 142 can be constructed similar to the corresponding support brackets 40 and 42, but to accommodate an opposite hinging orientation. Indeed, those skilled in the art may prefer to construct the support brackets 40 and 140 as a single piece, but to be universally used with each pivotal vertical support leg 30 or 130.

When the cable 44 is pulled in the direction of arrow 48, the clamp 46 forces the double hinge center bracket 38 horizontally to the right. At the same time, when the second cable 144 is pulled to the left in the opposite direction as shown by arrow 148, the cable clamp 146 forces the double hinge center bracket 138 to the left to thereby cause the edgerail 28 to be raised. While not shown, the ends of the cables 44 and 144 can be routed around respective cable guide end brackets (not shown) that are fixed to opposite ends of the stationary ridgebeam 16. The ends of the cable 44 and 144 can be coupled to the same winch so that both cables are tensioned equally as a result of the rotation of the winch take-up mechanism. In this manner, the first hinged support structure 30 of the pair will be moved by the same amount as the second hinged support structure 130 to thereby raise the edgerail 28 uniformly. Again, only a single person is required in order to raise a hinged roof with the apparatus shown in FIG. 9.

Figure 10:
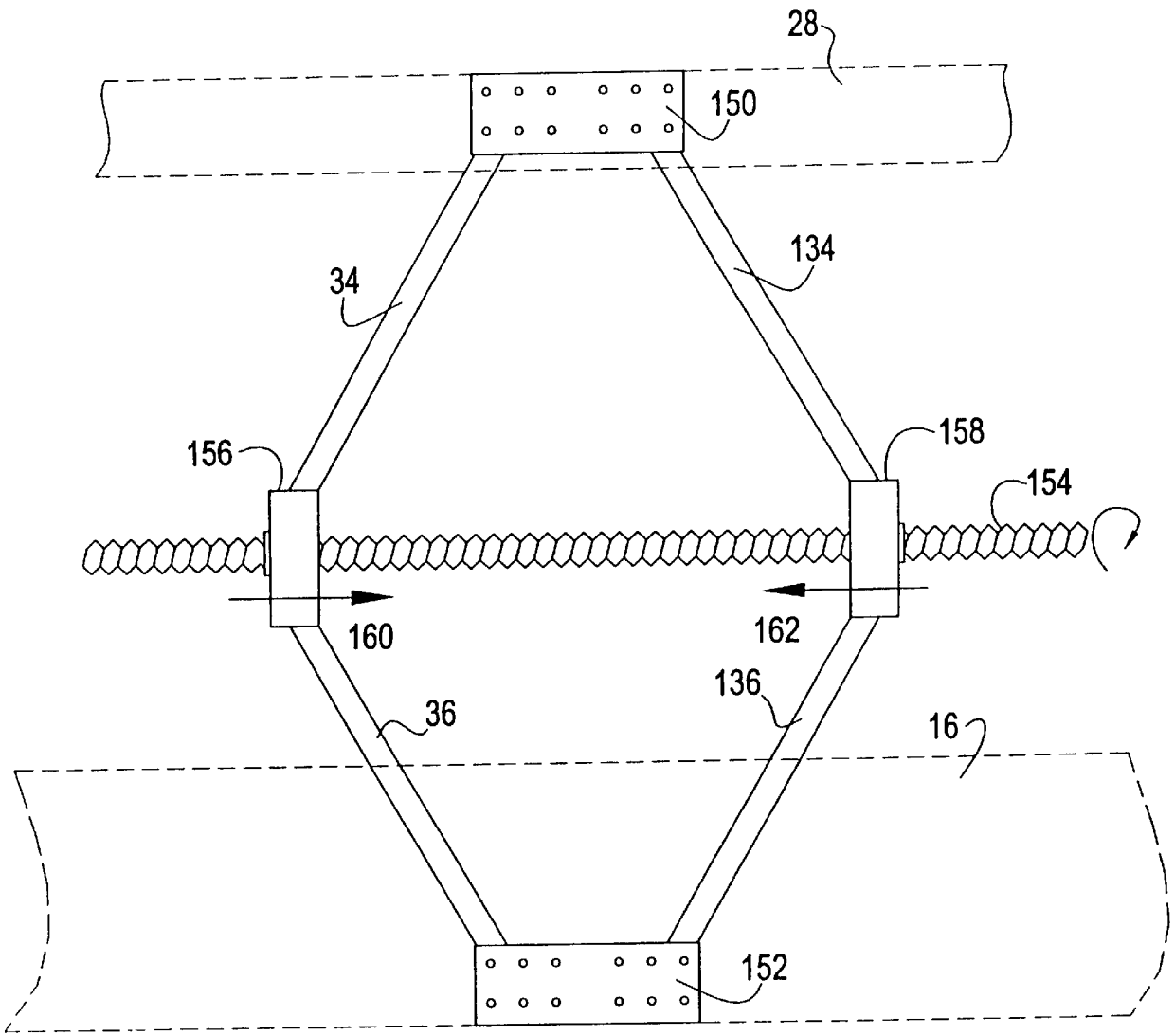
FIG. 10 is a side view of a pair of hinged support structures operated by a threaded screw arrangement.

In accordance with another embodiment of the invention, there is shown in FIG. 10 a hinged roof raising apparatus that is similar to that shown above in connection with FIG. 9. In FIG. 10, rather than utilizing separate top and bottom end brackets, only a single top end bracket 150 and a single bottom end bracket 152 are utilized, each with a pair of hinged connections to provide two degrees of pivotal movement of the respective support legs. Rather than utilizing cables, the embodiment of FIG. 10 employs an elongate threaded rod 154. The threaded rod 154 has right hand threads on one end and left hand threads on the other end. One double hinge center bracket 156 is fitted with a collar (not shown) having a right-hand threaded bore for accommodating the threaded rod 154. The other double hinge center bracket 158 includes a collar having a left-hand thread for accommodating the threaded rod 154. With this arrangement, when the threaded rod 154 is rotated in one direction, the center double hinge bracket 156 will move in the direction of arrow 160 and the other double hinge center bracket 158 will move in an opposite direction, as shown by arrow 162. When moved in the noted directions, the edgerail 28 is raised upwardly with respect to the stationary ridgebeam 16. When the threaded rod 154 is rotated in the opposite direction, the double hinge center brackets 156 and 158 move apart, thereby lowering the edgerail 128 toward the ridgebeam 16. An inexpensive gear reduction mechanism and an electric drill engaged with the end of the threaded rod 154 can be utilized to raise or lower the hinged roof in the manner described above. Those skilled in the art may also prefer to employ the threaded rod arrangement in the embodiment of FIG. 2.

Figure 11:
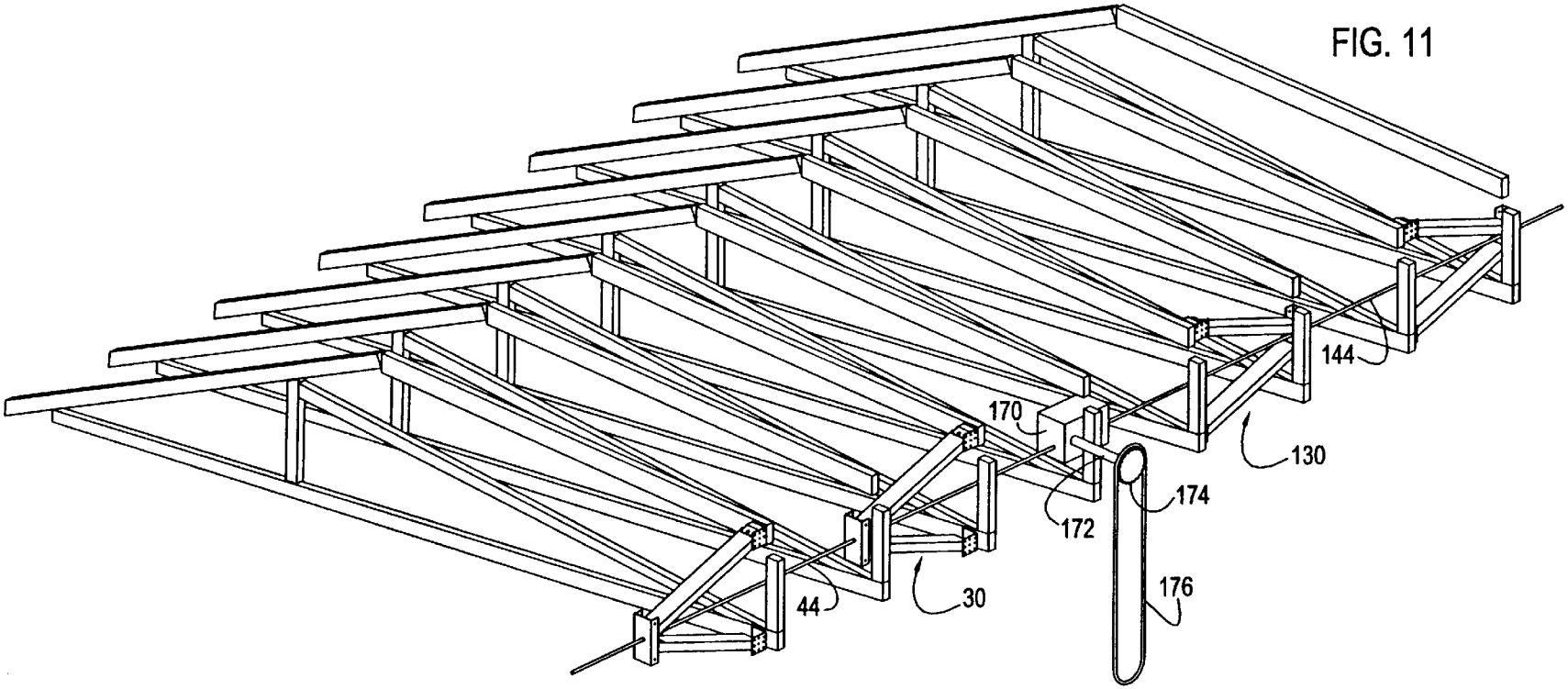
FIG. 11 is an isometric view of a cabling arrangement according to the preferred embodiment for pulling on the cable at the center to unfold and extend the hinged support structures.

FIG. 11 illustrates the preferred embodiment of the invention. Again, for purposes of clarity, the ridgebeam and movable edge rail are not shown. Here, there are shown a plurality of hinged support structures 30, half of which are rotated 180°. The left hand half of the hinged roof is equipped with the hinged support structures 30, while the right hand half of the roof is equipped with the rotated hinged support structures 130. A worm gear reduction mechanism 170 is anchored to the ridge beam via a truss king post. The worm gear reduction mechanism 170 has a cable take-up reel (not shown) to wind half the cable 44 on the reel in one direction, and wind the other half of the cable 144 on the reel in the other direction. Thus, by activating the worm gear reduction mechanism, the hinged support structures 30 and the other hinged support structures 130 simultaneously unfold in a uniform manner. The worm gear reduction mechanism 170 preferably has a shaft 172 that extends through a hole in the ridgebeam. A chain sprocket wheel 174 is keyed or otherwise fixed to the shaft 172. A long endless chain 176 can be engaged with the sprocket wheel 174 so as to be reachable by a worker during raising of the hinged roof. The worm gear reduction mechanism 170 is preferably of a ratio such that a worker can easily pull on the chain 176 to cause movement of the cables 44 and 144. By pulling the chain 176 so as to cause rotation of the sprocket wheel 174 in one direction, the roof can be raised. When the chain is pulled so as to cause rotation of the sprocket wheel 176 in the other direction, the roof can be lowered. Because of the worm gear type of mechanism, the weight of the roof will not cause the mechanism to unwind. Thus, no ratchet mechanism, lock or brake is necessary. When the hinged roof is fully raised, the left and right hand hinged support structures 30 and 130 can be fixed as straight members, by nailing through the double hinged center brackets 38. Once fixed, the worm gear mechanism 170 can be removed, as well as the cables 44 and 144.

Figures 12, 13:
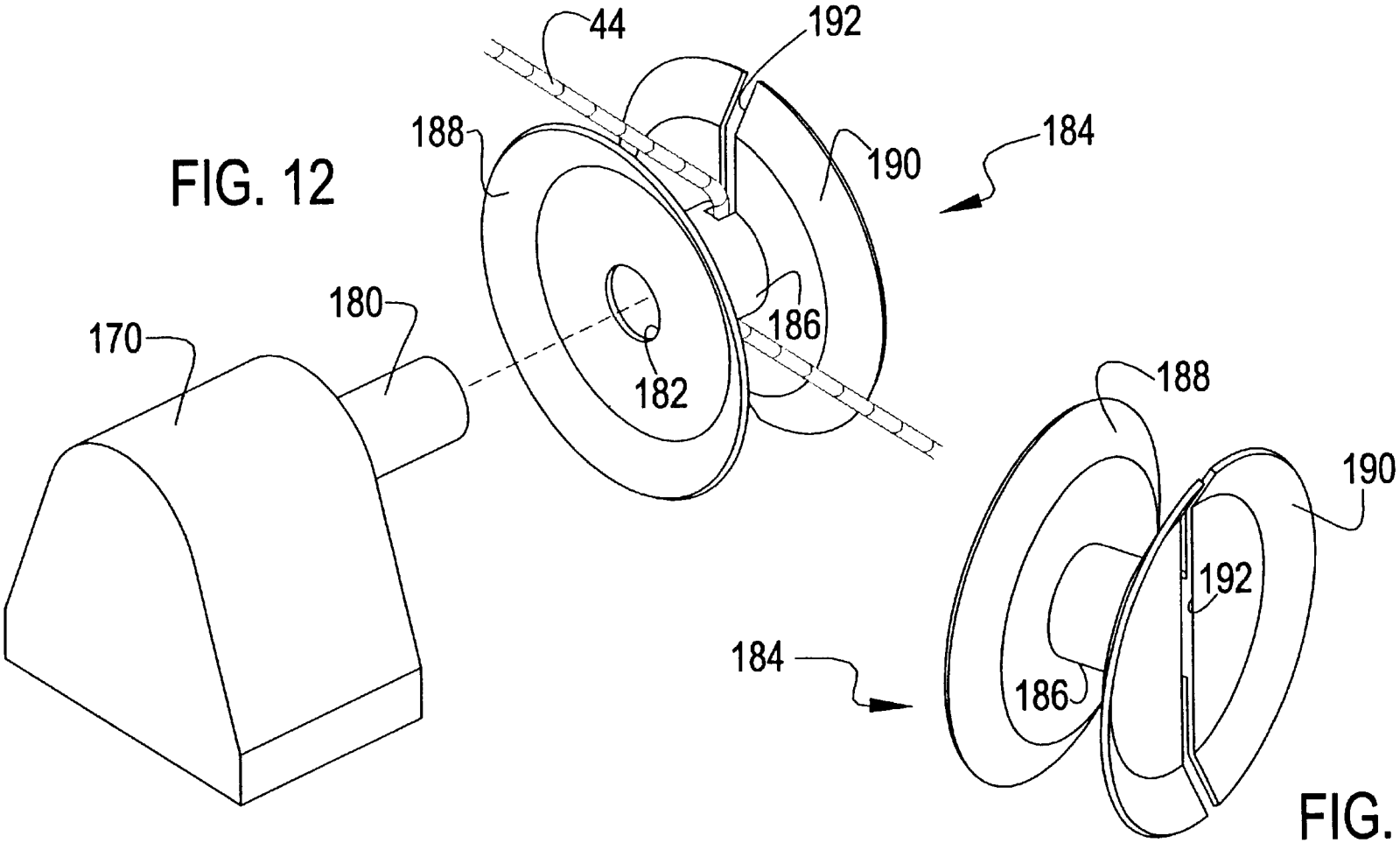
FIG. 12 is an isometric diagram illustrating a technique for engaging a wind-up drum to a cable for pulling the cable to raise the hinged roof.
FIG. 13 is an isometric diagram of another view of the wind-up drum shown in FIG. 12.

FIGS. 12 and 13 illustrate respectively a left and right isometric view of a cable take-up drum and worm gear reduction mechanism. The gear box 170 has an output shaft 180 that is fastened within the bore 182 of a cable take-up drum 184 by a suitable means, such as a key and key slot, set screw, etc. The take-up drum 184 includes a hub 186 on which the cable 44 is wound. Importantly, the take-up drum 184 is constructed so that a single cable 44 can be utilized for connection to both the hinged support structures 30, as well those that are installed in a reverse manner 130, such as shown in FIG. 11. Thus, two separate cables are not required. The cable take-up drum 184 further includes opposing cable guards 188 and 190, each having a circumferential edge that is flared outwardly to gather the cable 44 and direct it toward the wind-up hub 186.

In accordance with an important feature of the cable take-up drum 184, a slot 192 is formed diametrically through the outside cable guard 190, as well as formed partially into the cylinder hub 186. The width of the slot 192 is somewhat larger than the diameter of the cable 44, which is preferably about ¼". All that is required to engage the cable 44 with the take-up drum 184 is to rotate the drum 184 so that the slot 192 is horizontal and aligned with the cable 44, whereupon the cable is fully inserted into the slot 192, such as shown in FIG. 12. Then, once the take-up drum 184 is rotated via the gear box 170, the cable 44 is prevented from inadvertent removal from the drum 184. Preferably, the portion of the slot 192 formed into the cylinder hub 186 is machined or otherwise ground so as to have a curved edge. This will prevent nicking and sharp bends within the cable 44.

The gear box 170 can be of any conventional type, such as a worm gear reduction gear box having an input shaft (not shown) and the output shaft 180. Different ratios can be selected so that depending upon the load to be driven, the input shaft can be easily turned by a sprocket and chain arrangement, such as shown in FIG. 11.

Figure 14:
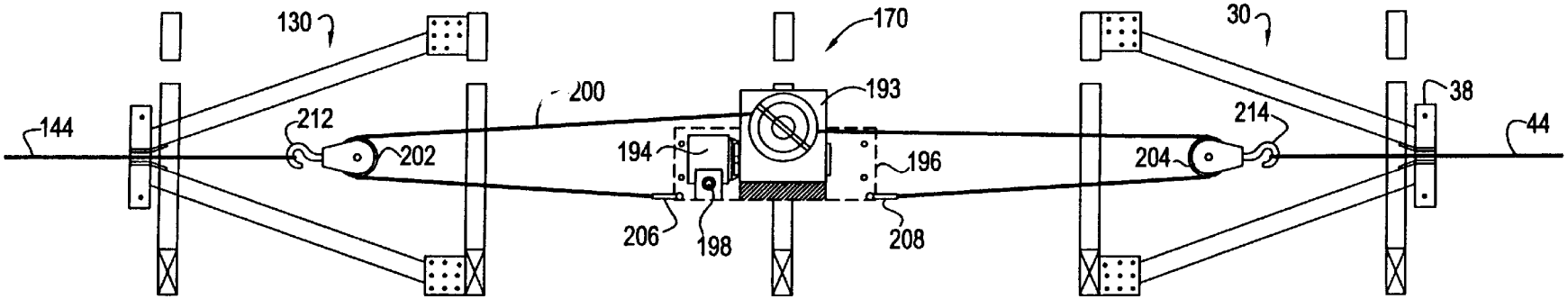
FIG. 14 is a diagram of the wind-up drum of FIG. 12 utilized in conjunction with a pair of pulleys to operate the hinged support structures and raise a hinged roof.

FIG. 14 illustrates another embodiment of the cable tensioning apparatus that is well adapted for lifting heavy loads, such as a long hinged roof with many hinged support structures. According to this arrangement, the worm gear reduction drive assembly 170 utilizes a first gear box 193 in conjunction with a second gear box 194. The gear box assembly 170 is preferably mounted to a mounting plate 196 which, in turn, is mounted to the stationary ridgebeam (not shown). An input shaft 198 associated with the second gear box 194 protrudes through the ridgebeam. A sprocket and chain arrangement, such as shown in FIG. 11, can be connected to the input shaft 198. In this manner, a worker can manually operate the gear box assembly 170 to easily raise the hinged roof It has been found that the load on each cable 44 and 144 in raising a seventy six foot hinged roof is about 3800 pounds. It has been found that by utilizing a gear reduction assembly 170 with a 40:1 reduction, the roof can be easily raised by a single workman. It is contemplated that the diameter of the sprocket wheel 174 (FIG. 11) will be about 8–10 inches in diameter.

In the roof raising arrangement shown in FIG. 14, the slotted drum 184 is engaged with a cable 200 that is routed through a first pulley 202 and a second pulley 204. The ends of the cables are coupled by a threaded rod and nut arrangement 206 and 208, each of which is anchored to the mounting plate 196 of the gear box assembly 170. The pulley 202 includes a hook 212 that is connected to a looped end of the cable 144. In like manner, a hook 214 of the pulley 204 is coupled to a hooked end of the other cable 44. When the gear box assembly 170 is operated so as to rotate the slotted drum 184 in either direction, the cable 200 is tensioned, which thereby causes the slack in each horizontal cable 44 and 144 to also be tensioned. By utilizing the pulleys 202 and 204, this increases the advantage on the gear box assembly 170 by a 2:1 ratio. In addition, by utilizing the pulley arrangement, a smaller gear box assembly can be employed, thereby reducing the overall weight of the apparatus. Yet other arrangements of gear boxes and ratios, as well as pulleys and multiple pulleys can be utilized for allowing a worker to easily raise hinged roofs of different lengths, and thus weights.

From the forgoing, disclosed are methods and apparatus for facilitating the raising of hinged-type roof structures. According to the method of the invention, only a single person is required to operate the winch, threaded rod or worm gear mechanism and thereby raise all parts of the roof simultaneously, irrespective of the length thereof Moreover, the hinged roof cannot be overraised due to the constraint of the hinged support structures which, when they become vertically aligned, are stopped and further raising of the roof cannot be accomplished. This reduces the possible damage to roof structures due to raising beyond the design limits. It can also be appreciated that by utilization of the hinged support structures, they not only facilitate the raising of the hinged roof, but also provide a permanent support structure that need not be removed. A further advantage of the apparatus of the invention is that all parts required for raising the roof can be assembled and fastened thereto at the factory and no loose parts need be transported with the mobile home. Moreover, the technique according to the invention allows the forces required for raising the roof to be borne by the sturdy ridgebeam member, thereby reducing the overall stresses and distortions on the mobile home structure. As noted above, the methods and apparatus of the invention provide many other advantages.

Although the preferred and other embodiments of the invention have been illustrated in the accompanying drawings and described in the forgoing detailed description, it will be understood that the principles and concepts of the invention are not limited to the embodiments disclosed, but are capable of numerous other arrangement, modifications and substitutions of parts elements, without departing from the spirit and scope of the invention, as defined by the appended claims.

What is claimed is:

1. A method of deploying a hinged building structure from a compact position to an expanded position, comprising the steps of: fixing a plurality of expandable support structures between parts of the building structure that are movable apart;

coupling together the plurality of expandable support structures with a coupling member;

exerting a force on said coupling member to thereby expand said expandable support structures to expand the parts of the building structure apart; and using said plurality of expandable support structures as a structural support to maintain the parts of the building structure separated during use of the building structure.

2. The method of claim 1, further including using a cable as said coupling member and horizontally pulling on said cable to expand said plurality of expandable support structures.

3. The method of claim 2, further including anchoring an end of said cable to one part of said building structure, and routing the cable 180° around said one part to apply a horizontal pulling force on said plurality of expandable support structures.

4. The method of claim 2, further including routing the cable laterally around one part of said building structure and between said plurality of expandable support structures and a cable take-up mechanism so that a minimum net force is exerted on said one part of said building structure.

5. The method of claim 2, further including pulling said cable in one direction to expand said plurality of expandable support structures, and pulling another cable in an opposite direction to expand a second set of expandable support structures.

6. The method of claim 1, further including expanding said building structure from a collapsed position to said expanded position by a single worker causing exertion of said force.

7. The method of claim 6, further including expanding all said parts of said hinged building structure at the same time by the single worker.

8. The method of claim 1, further including constructing each said expandable support structure using two support legs, and hingeably coupling an inner end of each said support leg together, and hingeably connecting an outer end of each said support leg to respective parts of the building structure, and applying a force adjacent to the hingeably coupled inner ends of the support legs.

9. The method of claim 1, further including fixing said, plurality of expandable support structures to the building parts at a factory, providing a hinged part to each of said plurality of expandable support structures and securing said hinged part of said plurality of expandable support structures at an installation site so as to prevent a hinging action.

10. The method of claim 1, further including fixing at least one end of each said expandable support structure to said building structure so as to be pivotal about two axes.

11. A method of deploying a hinged roof from a compact position to an expanded position, comprising the steps of:

fixing a plurality of hinged support structures between parts of a building that are movable apart;

coupling said plurality of said hinged support structures together via a horizontally disposed member; and actuating the horizontally disposed member to cause a hinging action of said plurality of hinged support structures and thereby cause vertical expansion of said plurality of hinged support structures to move said building to said expanded position.

12. The method of claim 11, wherein said horizontally disposed member comprises a cable, and said actuating comprises pulling on said cable.

13. The method of claim 11, wherein said horizontally disposed member comprises a threaded rod, and said actuation comprises rotating said threaded rod.

14. The method of claim 11, further including fixing said plurality of hinged support structures to said building so as to provide a permanent support structure thereto.

15. The method of claim 11, further including simultaneously actuating said horizontally disposed member by a single worker to thereby move each said hinged support structure.

16. The method of claim 11, further including raising said hinged roof from said compact position to a final expanded position without lowering the hinged roof to said final expanded position.

17. A hinged support structure for use in deploying a hinged building structure from a compact position to an expanded position, comprising:

a first support leg;

a second support leg;

at least one center hinge hingeably connecting respective first ends of said first and second support legs together; and a pair of hinged end brackets, each hinged end bracket fastened to a respective second end of said first and second support legs, each said hinged end bracket allowing pivotal movement of the respective support leg second end therein as said hinged end brackets are moved away from each other.

18. The hinged support structure of claim 17, wherein said center hinge further includes means for stopping over rotation thereof.

19. The hinged support structure of claim 17, wherein said center hinge comprises a pair of hinges, each hinge of said pair having a first flap fixed to one of said first and second support legs, and each said hinge having a second flap fixed to a channel member.

20. The hinged support structure of claim 19, wherein said channel member includes a hole therein for passing a cable therethrough.

21. The hinged support structure of claim 19, further including a cable clamp fixed to said channel member.

22. The hinged support structure of claim 19, wherein said channel member is fixed to said first and second support legs when said first and second support legs are hingeably moved so as to be aligned in a straight line.

23. The hinged support structure of claim 17, wherein at least one of said hinged end brackets is structured so that one of said first or second support legs is pivotal about two axes with respect to said one hinged end bracket.

24. The hinged support structure of claim 23, wherein a first axis of pivotal movement of said one said first or second support leg is through a hinge axis of a hinge connected to an end of said one said first or second support leg, and a second axis of pivotal movement of said one said first or second support leg is about an axis perpendicular to said hinge axis.

25. The hinged support structure of claim 24, wherein said second axis of pivotal movement is about a pin fixing said one said first or second support leg to a respective said end bracket.

26. The hinged support structure of claim 17, wherein said hinged end brackets each include a stop member to prevent over rotation of a respective said first or second support leg.

27. A hinged support structure for use in deploying a hinged roof from a compact position to an expanded position, comprising:

a first and second support leg;

a center bracket having a first and second hinge, said first hinge connected to said first support leg and said second hinge connected to said second support leg, and a channel member fixed to said first and second hinges, said channel member capturing said first and second support legs when said first and second support legs are pivoted so as to be aligned with each other in a straight line;

a first end bracket including a third hinge with a flap, said first end bracket being fixed to an end of said first support leg by a pin extending through said first support leg, said pin being fastened to the flap of said third hinge so as to be perpendicular to an axis of said third hinge, and said third hinge being fixed to a rigid bracket, a stop fixed to said rigid bracket for preventing hinging movement of said first support leg beyond a position in which said first and second support legs are aligned in said straight line; and a second end bracket having a fourth hinge and a rigid bracket, said second end bracket being fixed to an end of said second support leg.

* * * * *